US010130148B1

(12) United States Patent
Au et al.

(10) Patent No.: US 10,130,148 B1
(45) Date of Patent: Nov. 20, 2018

(54) SNAP BUTTON

(71) Applicant: Duraflex Hong Kong Limited, Hong Kong (CN)

(72) Inventors: Wai Leung Au, Hong Kong (CN); Yick Fai Chan, Hong Kong (CN)

(73) Assignee: Duraflex Hong Kong Limited, Sheung Wan, Hong Kong (CN)

( * ) Notice: Subject to any disclaimer, the term of this patent is extended or adjusted under 35 U.S.C. 154(b) by 0 days.

(21) Appl. No.: 15/826,862

(22) Filed: Nov. 30, 2017

(51) Int. Cl.
*A44B 17/00* (2006.01)

(52) U.S. Cl.
CPC ..... *A44B 17/0076* (2013.01); *A44B 17/007* (2013.01); *A44B 17/0041* (2013.01); *A44D 2201/06* (2013.01); *A44D 2201/50* (2013.01)

(58) Field of Classification Search
CPC ..... A44B 17/0076; A44B 17/0041; A44B 17/007
See application file for complete search history.

(56) References Cited

U.S. PATENT DOCUMENTS 2,585,897 A * 2/1952 Johnson ..... A44B 17/0041 24/690
2,683,908 A * 7/1954 Carpinella ..... A44B 17/0082 2/123
3,195,200 A * 7/1965 Daddona, Jr. ..... A44B 17/0041 24/690
3,538,557 A * 11/1970 Hirose ..... A44B 17/0076 24/662
4,562,624 A * 1/1986 Kanzaka ..... A44B 17/0029 24/621
4,641,401 A * 2/1987 Hasegawa ..... A44B 17/0076 24/108
5,933,929 A * 8/1999 Kawakami ..... A44B 17/0035 24/324
6,067,694 A 5/2000 Candotti
9,839,263 B2 * 12/2017 Villa ..... A44B 17/0052
2006/0021198 A1 * 2/2006 Raccosta ..... A44B 17/0082 24/104
2011/0113600 A1 * 5/2011 Hasegawa ..... A44B 17/0023 24/594.11
2012/0124791 A1 * 5/2012 Hasegawa ..... A44B 17/007 24/596.1
2014/0137373 A1 * 5/2014 Villa ..... A44B 17/0023 24/108
2015/0320151 A1 * 11/2015 Raccosta ..... A44B 17/0011 24/630

FOREIGN PATENT DOCUMENTS

EP 3 222 162 A1 9/2017

* cited by examiner

*Primary Examiner* — Robert Sandy
*Assistant Examiner* — David M Upchurch
(74) *Attorney, Agent, or Firm* — Collard & Roe, P.C.

(57) ABSTRACT

A snap button has a female portion formed from a cap and a socket that are connected together with a piece of fabric in between. The cap is formed from a base body having a circumferential flange with interruptions therein so that the flange can be bent outward during assembly. The socket is formed by a disc having a central aperture and a peripheral rim, as well as an annular insert disposed within the socket. The cap is connected to the socket by pressing the socket onto the cap until the flange bends around the annular insert to anchor the cap to the socket with the fabric trapped between. A male portion having a stud is connected to the female portion by snapping the stud into the socket such that the stud extends entirely through the socket and into the cap.

22 Claims, 7 Drawing Sheets

SNAP BUTTON

BACKGROUND OF THE INVENTION

1. Field of the Invention

This invention relates to a snap button for use in connecting two articles together. In particular, the invention relates to a snap button that is very low profile and simple to assemble.

2. The Prior Art

Snap buttons are generally formed by four separate pieces: a cap and socket forming the female part of the snap, and a stud and post forming the male part of the snap. Fabric is placed between the cap and socket, and also between the stud and post, so when the stud is snapped in to the socket, the two pieces of fabric are connected together. One problem with traditional snap buttons is that they can be bulky—connecting four separate parts together can add to the weight and size of the snap, making it cumbersome and unattractive. In addition, the majority of the snap tends to be situated between the two layers of fabric, so the connection of the fabric is not ideal as water, air and dirt can enter.

In addition, traditional metal snaps can be noisy to engage and disengage, thus making them undesirable for use in some situations, such as on hunting gear.

SUMMARY OF THE INVENTION

It is therefore an object of the invention to provide a snap button that is very low profile and does not distract from the articles being connected. It is another object of the invention to provide a snap button that can be engaged and disengaged quietly.

These and other objects are accomplished by a snap button having a female portion and a male portion. The female portion is formed from a cap and a socket that are connected together with a piece of fabric in between. The cap is formed from a base body having a top surface, a bottom surface, and a circumferential flange extending from the bottom surface. The flange has a plurality of interruptions therein so that the flange can be bent outward during assembly. The socket is formed by a disc having a top surface, a bottom surface, a central aperture and a peripheral rim extending from top surface, as well as an annular insert disposed within the socket. The cap is connected to the socket by pressing the socket onto the cap until the flange bends around the annular insert to anchor the cap to the socket with the fabric trapped between. The insert is preferably S-shaped in cross-section, and the flange bends around the curve of the S to connect the cap and socket. The flange preferably has a series of evenly arranged interruptions to create prongs. The prongs can have a curved profile. Preferably, the prongs extend from the cap at an angle of between 90 and 100 degrees, which facilitates bending of the prongs by a die machine during assembly. The base body and flange are preferably formed from metal.

A male portion having a stud is connected to the female portion by snapping the stud into the socket such that the stud extends entirely through the socket and into the cap. This arrangement has several advantages. First, because the stud extends all the way to the cap, essentially through the fabric between the cap and socket, the fabric connected to the male portion and the fabric connected to the female portion can be situated very close together, improving function of the article or clothing to which the snap is attached. In addition, the cap over the socket protects the stud and prevents inadvertent separation of the parts even upon impact.

The male portion can be any standard male snap portion having a stud for insertion into the female portion. In particular, the male portion can be made of two components: a post formed by a disc having a protrusion extending from the disc, and the stud formed by a disc having an indent corresponding to the shape of the post. The stud is connected to the post by inserting the post into the indent. A portion of the stud is narrower than the post so that post is maintained in the stud by force-fit. The post and stud are connected around a layer of fabric by placing the post through a hole in the fabric prior to insertion into the indent of the stud.

In a preferred embodiment, there are a set of teeth arranged circumferentially around an inside of the flange of the cap. The teeth are configured to grip the stud when the stud is inserted into the female portion. The teeth can have a protrusion extending inwardly near the top surface of each tooth, to help grip the stud. The teeth are formed by a plastic insert that is placed in the cap underneath the metal flange. The use of plastic makes the snapping and unsnapping of the snap button very quiet and reduces the vibrations created during use. The plastic also flexes under pressure and allows the stud to be inserted. In addition, because of the air gaps between the teeth, there is no popping sound due to escaping air when the snap is engaged and disengaged. There are preferably between two and five teeth. The flange and base body of the cap are made of separate pieces of metal to allow for assembly of the tooth insert between them.

In another embodiment, the flange is formed in one piece with the base body of the cap. The cap is connected to the socket in the same manner described above. In this embodiment, the insert with the teeth is absent and the stud is inserted directly into the socket and held there by a traditional ring spring in the socket. In this embodiment, there are plurality of spikes arranged on the bottom side of the base body circumferentially around an outside of the flange. The spikes are configured for gripping a layer of fabric disposed between the cap and socket when the cap and socket are connected.

In both embodiments, the stud extends entirely through the socket to the cap, making for a very low-profile snap button.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
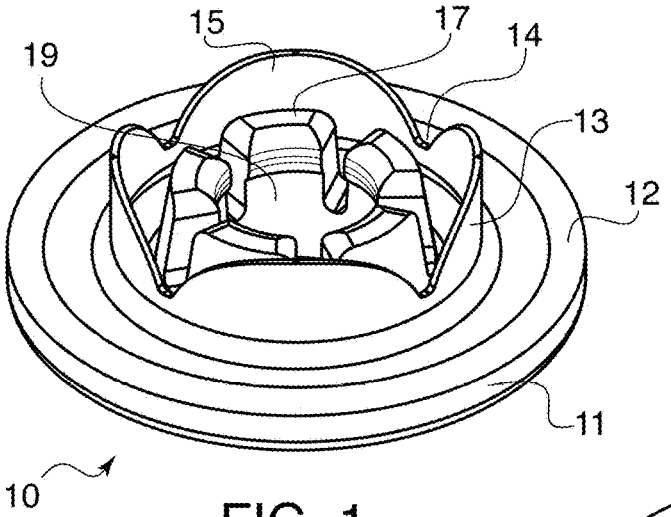
FIG. 1 shows a perspective view of the cap for the snap button according to the invention.
Figure 2:
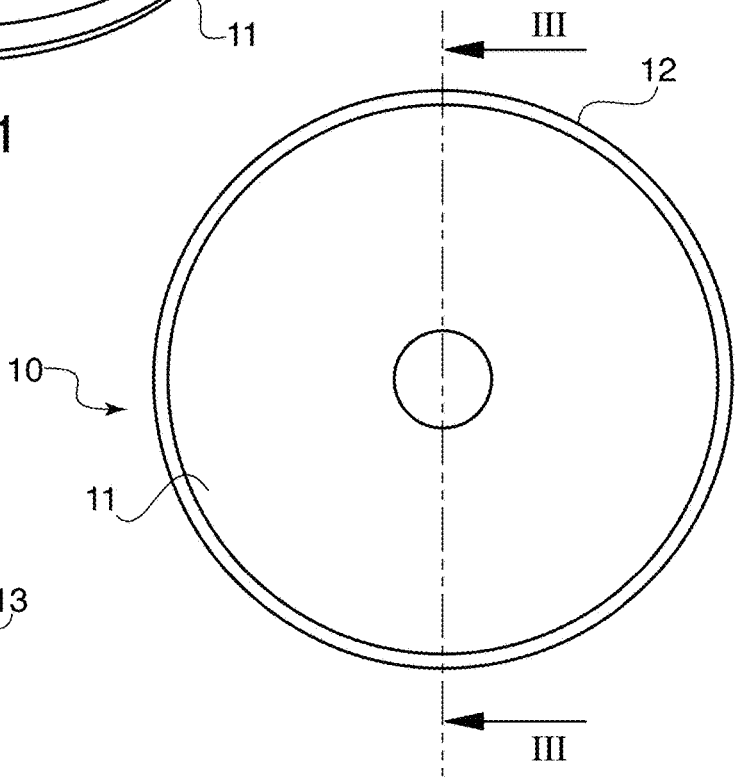
FIG. 2 shows a top view of the cap.
Figure 3:
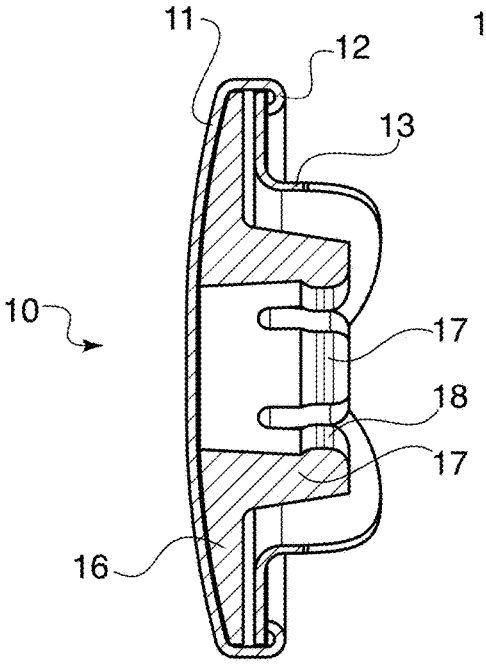
FIG. 3 shows a cross-sectional view along lines III-III of FIG. 2.

Referring now in detail to the drawings, FIGS. 1-3 show the cap 10 of the snap button according to the invention. Cap 10 has a base body 11 with a rim 12, and an annular flange 13 extending up from base body 11. Annular flange 13 has a plurality of interruptions 14 around its circumference, to form a plurality of evenly distributed prongs 15. Disposed inside base body 11 and underneath flange 13 is an insert 16 having a plurality of teeth 17 arranged in a circumferential manner on the inside of flange 13. Insert 16 is preferably made of plastic, and teeth 17 are preferably arranged with a spacing in between the teeth.

Figure 4:
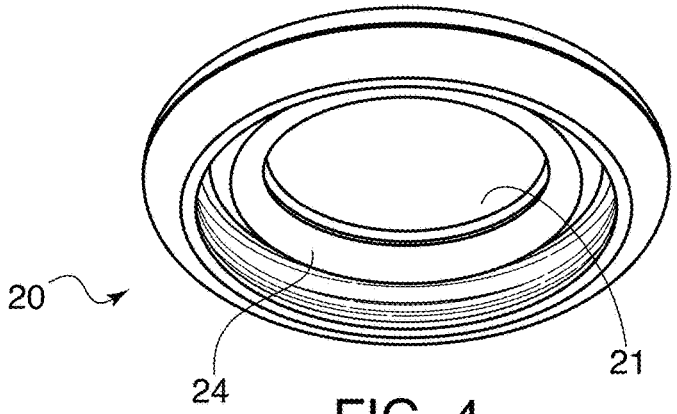
FIG. 4 shows a perspective view of the socket for the snap button according to the invention.
Figure 5:
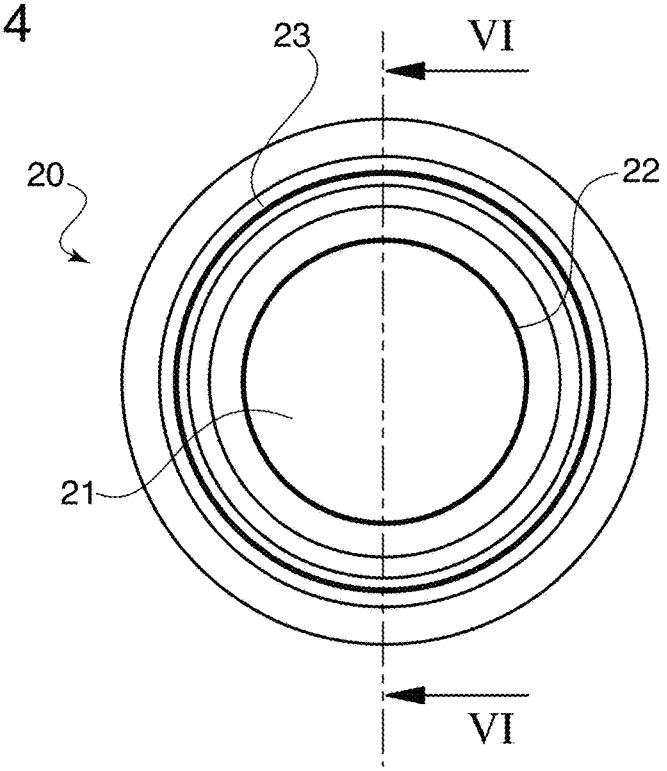
FIG. 5 shows a top view of the socket.
Figure 6:
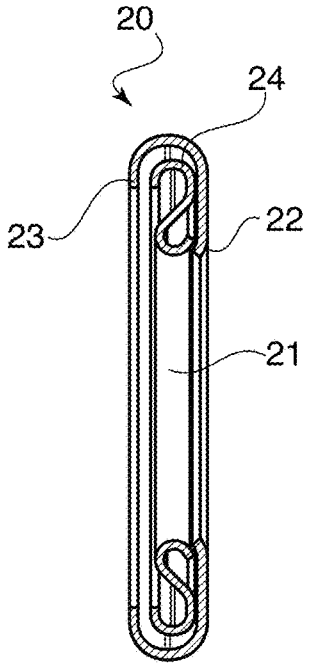
FIG. 6 shows a cross sectional view along lines VI-VI of FIG. 5.

FIGS. 4-6 show the socket 20 according to the invention. Socket 20 is annular in shape, with a central aperture 21, a top rim 22 and a bottom rim 23. The top rim 22 is smaller in circumference than the bottom rim 23. An annular insert 24 is disposed between the top and bottom rims. Annular insert 24 has an S-shaped cross section.

Figure 7:
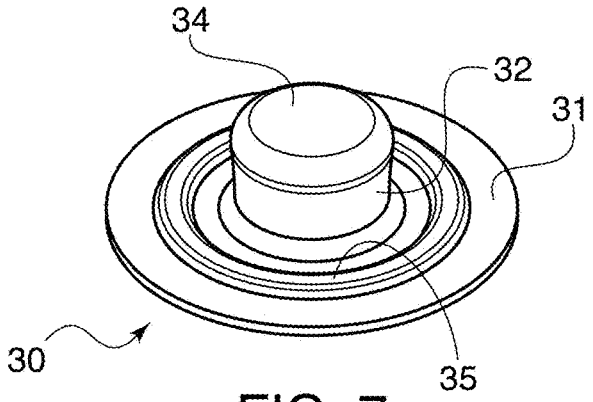
FIG. 7 shows a perspective view of the stud for the snap button according to the invention.
Figure 8:
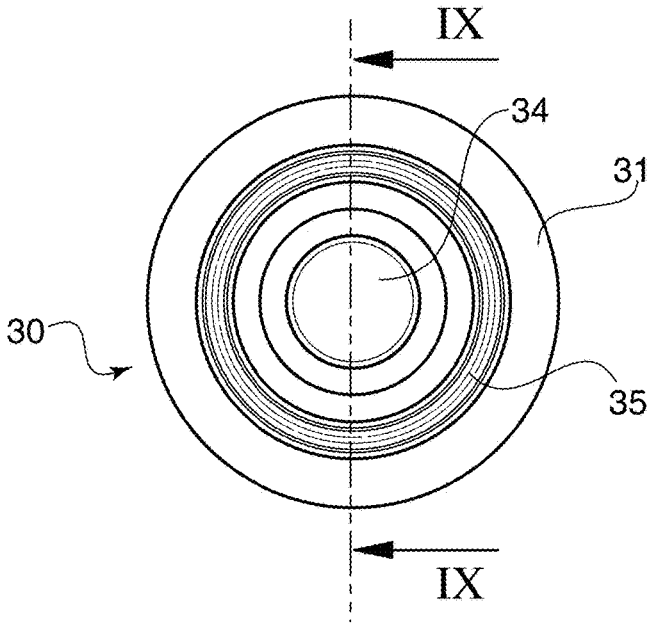
FIG. 8 shows a top view of the stud.
Figure 9:
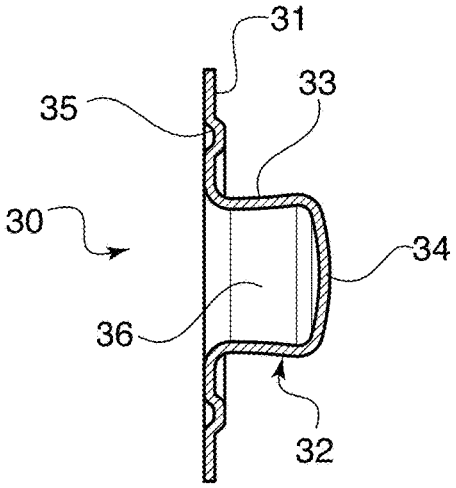
FIG. 9 shows a cross-sectional view along lines IX-IX of FIG. 8.

FIGS. 7-9 show the stud element 30 according to the invention. Stud element 30 has a disc-shaped base 31 with the stud 32 extending upward therefrom. Stud 32 has a circumferential side wall 33 and a top surface 34, with an indentation 36 within side wall 33. The base 31 can have a ridge 35 extending around it.

Figure 10:
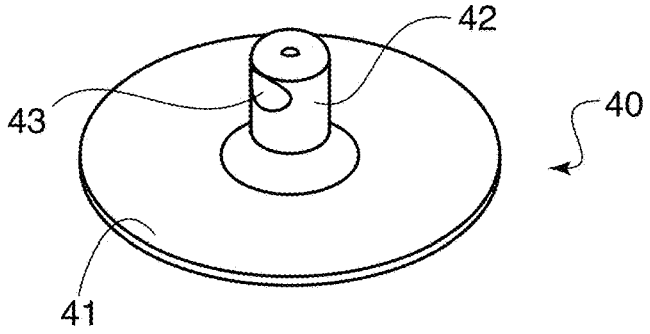
FIG. 10 shows a perspective view of the post for the snap button according to the invention.
Figure 11:
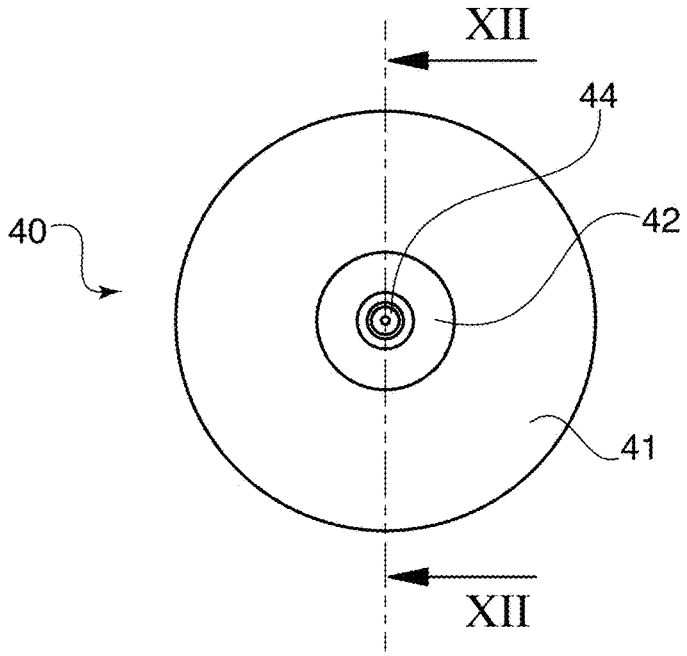
FIG. 11 show a top view of the post.
Figure 12:
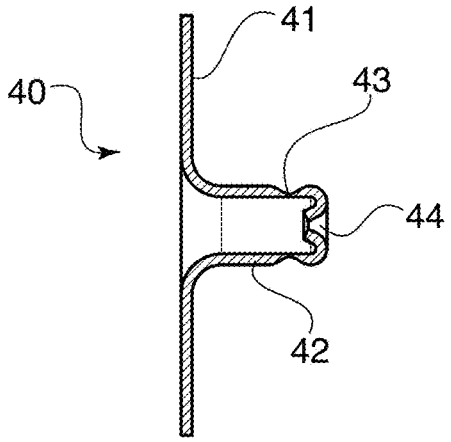
FIG. 12 shows a cross-sectional view along lines XII-XII of FIG. 11.

FIGS. 10-12 show the post 40 according to the invention. Post 40 is comprised of a disc shaped base 41 and a post element 42 extending upward therefrom. Post element 42 can have one or more indentations 43 on its side, and an indentation 44 on its top surface.

Figure 13:
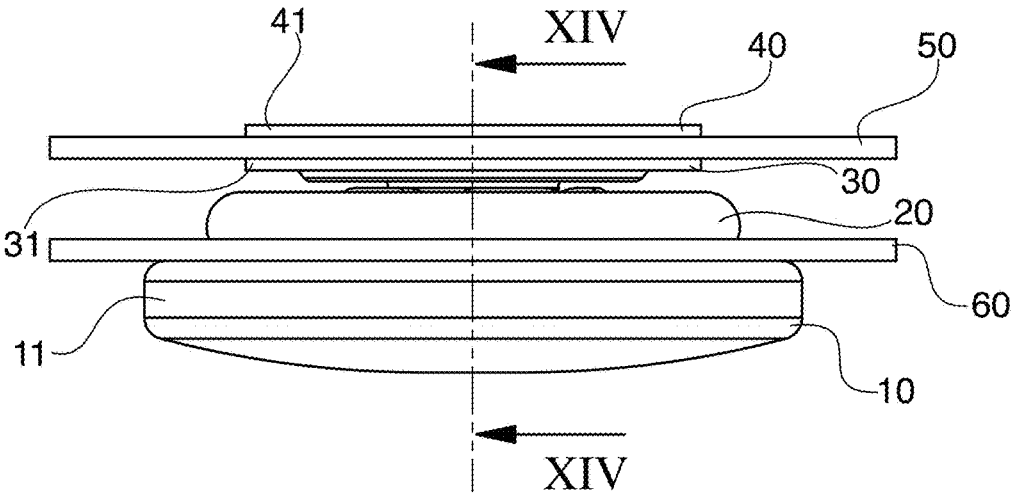
FIG. 13 shows a side view of the snap button assembled on two pieces of fabric.
Figure 14:
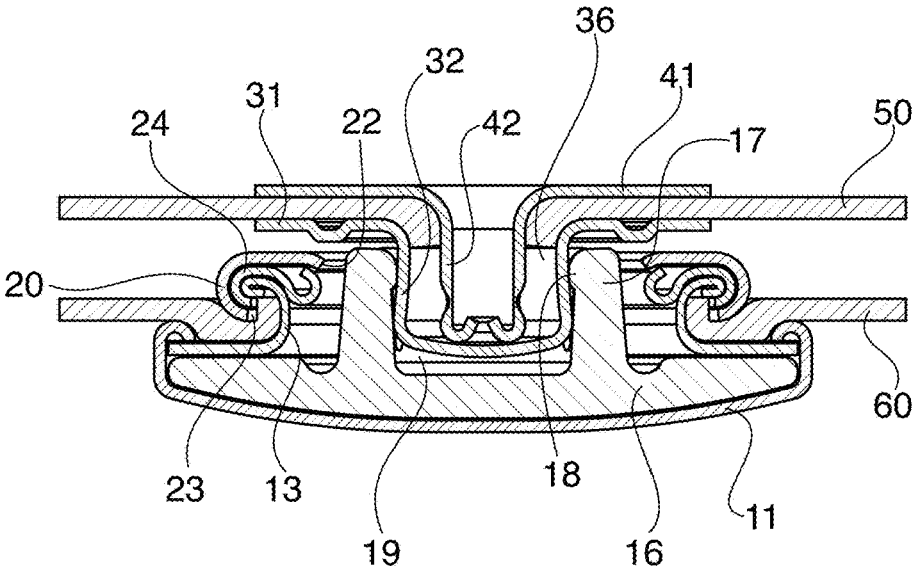
FIG. 14 shows a cross-sectional view along lines XIV-XIV of FIG. 13.

The cap 10, socket 20, stud element 30 and post 40 can all be assembled around two layers of fabric to create a snap button to connect the two layers of fabric, as shown in FIGS. 13-14. Post element 42 of post 40 is inserted through a hole in fabric 50. The edges of fabric 50 bend around the base of post element 42 to allow post 40 to connect to stud 30 via force fit.

Cap 10 is connected to socket 20 by forming a hole in a layer of fabric 60, inserting flange 13 through the hole, and pressing flange 13 around insert 24 of socket 20 until the prongs of flange 13 bend around insert 24 to anchor cap 10 to socket 20. This pressing can be done by a die press. The evenly distributed prongs help distribute the force from the die machine during pressing. After this pressing, the teeth 17 extend through socket 20 until just past top rim 22.

The female portion of the snap button formed by cap 10 and socket 20 can be connected to the male portion of the snap button by inserting stud 32 into the space 19 formed between teeth 17. Teeth 17 have an inwardly extending protrusion 18, which presses against stud 32 to keep stud 32 connected to cap 10. After assembly, stud 32 extends entirely through socket 20, to the inside surface of insert 16 of cap 10, and thus extends not only through fabric layer 50, but through fabric layer 60 as well. This way, the connection between the male and female components of the snap button takes place not between the two layers of fabric as with most snap buttons, but outside both layers. Due to this feature, the layers of fabric are connected to each other more closely, which creates a better closure against air and water.

Figure 15:
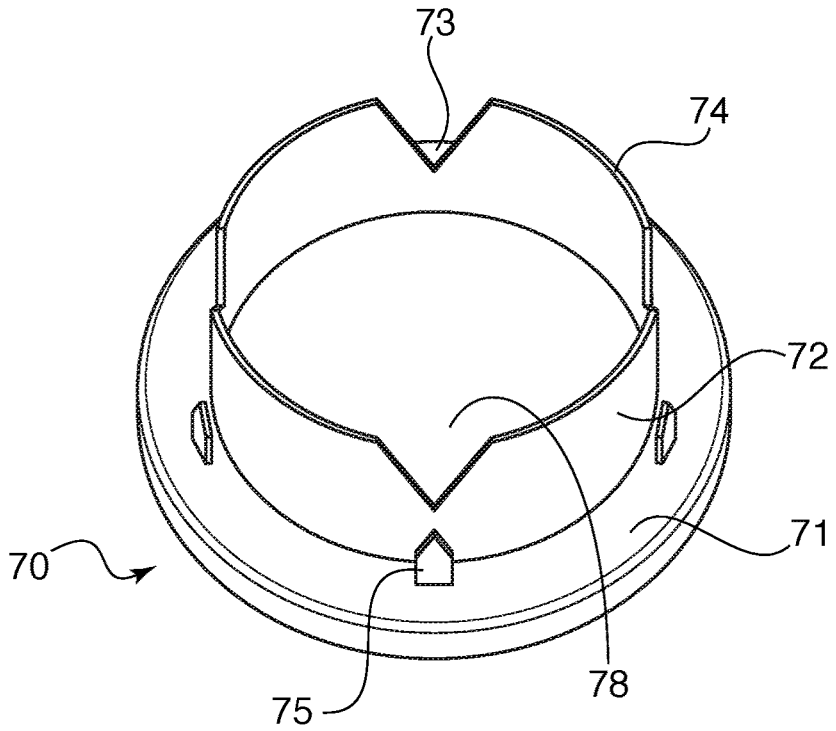
FIG. 15 shows an alternative embodiment of the cap for the snap button according to the invention.
Figure 16:
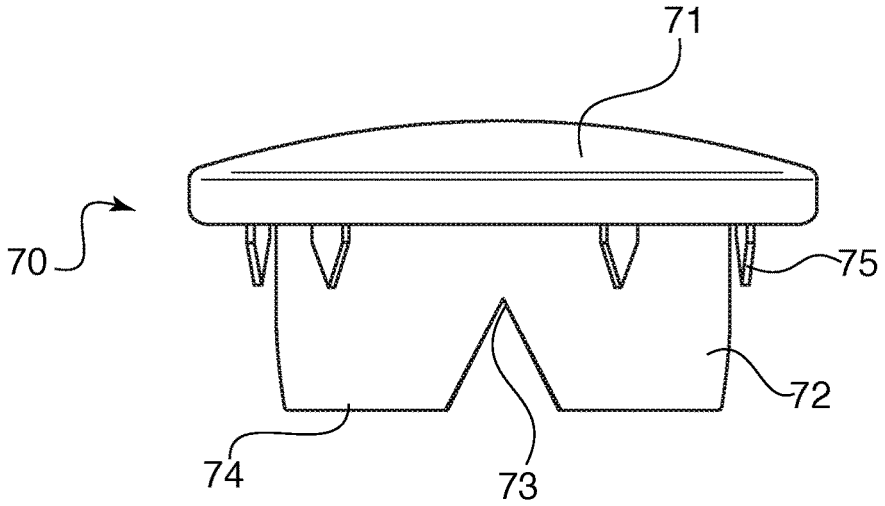
FIG. 16 shows a side view of the cap of FIG. 15.

A second embodiment of the female portion of the snap button according to the invention is shown in FIGS. 15-19. FIGS. 15 and 16 show the cap 70 according to this second embodiment. Here cap 70 is formed from a base body 71 connected to a flange 72 having interruptions 73 to form prongs 74. A plurality of spikes 75 are arranged on base body 71 around the outside of flange 72 and extend substantially perpendicular to base body 71.

Figure 17:
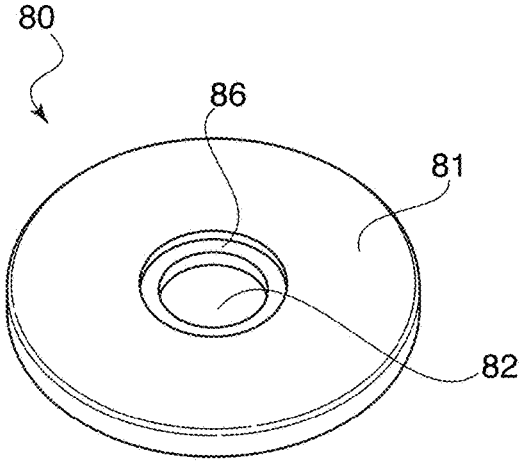
FIG. 17 shows a top view of the socket for use with the cap of FIG. 15.
Figure 18:
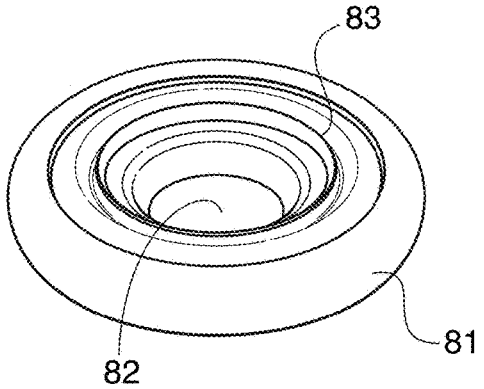
FIG. 18 shows a bottom view of the socket of FIG. 17.
Figure 19:
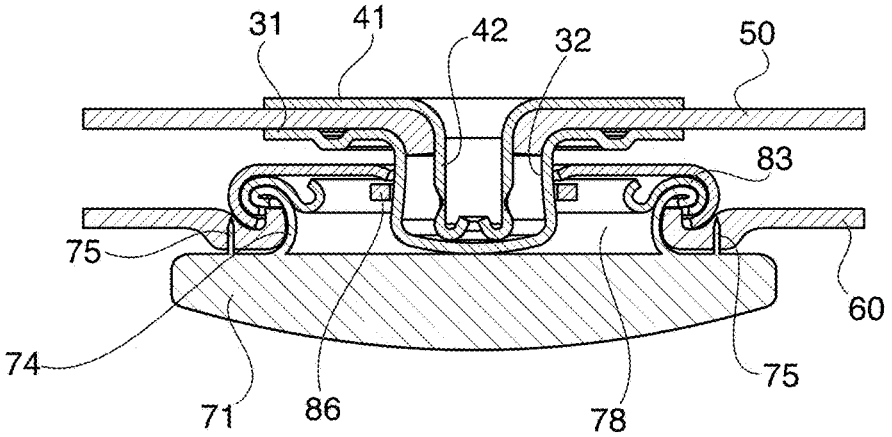
FIG. 19 shows a cross-sectional view of the snap button using the cap and socket of FIGS. 15-18.

FIGS. 17 and 18 show the socket 80 for use with cap 70. Socket 80 is formed from a base body 81 having a central aperture 82 with a ring spring 86 disposed in the aperture 82. An annular insert 83 is arranged in base body 81. Insert 83 has an S-shaped cross section. In use, cap 70 is assembled to socket 80 by inserting prongs 74 through a hole in fabric 60 and pressing prongs 74 into socket 80 until prongs 74 bend around insert 83, as shown in FIG. 19. At the same time, spikes 75 are pressed through fabric 60 to further secure fabric 60 to cap 70. Spikes 75 keep the fabric in place and prevent damage to the central hole in the fabric, even if the fabric is pulled or dragged during use.

Cap 70 and socket 80 can be used with the same stud 30 and post 40 as shown in FIGS. 7-14. The entire assembly is shown in FIG. 19. Because there are no teeth to grip stud 32, a ring spring 86 is mounted in socket 80. Ring spring expands upon insertion of stud 30 and the pressure of spring 86 against stud 32 keeps stud 32 connected to socket 80. As with the previous embodiment, stud 32 extends entirely through socket 80 to the base body 71 of cap 70, so that the connection of the male and female parts does not take place entirely between the two layers of fabric 50, 60, but toward the outside of layer 60.

Accordingly, while only a few embodiments of the present invention have been shown and described, it is obvious that many changes and modifications may be made thereunto without departing from the spirit and scope of the invention.

What is claimed is:

1. A snap button comprising:

a female portion comprising:

a cap formed from a base body having a top surface, a bottom surface, a circumferential flange extending from said bottom surface, said flange having a plurality of interruptions therein;

a socket formed by a disc having a top surface, a bottom surface, a central aperture and an annular insert disposed within the socket, wherein the cap is connected to the socket by pressing the socket onto the cap until the flange bends around the annular insert to anchor the cap to the socket; and a male portion comprising:

a post formed by a disc having a protrusion extending from the disc; and a stud formed by a disc having an indent corresponding to the shape of the protrusion, wherein the stud is connected to the post by inserting the protrusion into the indent;

wherein the male portion is connected to the female portion by snapping the stud into the socket such that the stud extends through the socket and into the cap.

2. The snap button according to claim 1, wherein the flange is formed of a separate piece from the base body of the cap and is anchored to the cap.

3. The snap button according to claim 1, further comprising a set of teeth arranged circumferentially around an inside of the flange, said teeth being configured to grip the stud when the stud is inserted into the female portion.

4. The snap button according to claim 3, wherein the teeth are made of plastic and the base body and flange are made of metal.

5. The snap button according to claim 3, wherein the teeth are disposed on a plastic insert that is placed between the base body and the flange.

6. The snap button according to claim 1, wherein the insert in the socket has an S-shaped cross-section.

7. The snap button according to claim 1, further comprising a plurality of spikes arranged on the bottom surface of the base body circumferentially around an outside of the flange, said spikes being configured for gripping a layer of fabric disposed between the cap and socket when the cap and socket are connected.

8. The snap button according to claim 3, wherein there are between two and five teeth.

9. The snap button according to claim 1, further comprising a ring spring disposed in the socket to grip the stud when the stud is inserted into the central aperture in the socket.

10. A snap button comprising:

a female portion comprising:

a cap formed from a base body having a top surface, a bottom surface, a circumferential flange extending from said bottom surface, said flange having a plurality of interruptions therein, and a plastic insert placed between the base body and the flange, the plastic insert having a set of teeth arranged circumferentially around an inside of the flange;

a socket formed by a disc having a top surface, a bottom surface, a central aperture and an annular insert disposed within the socket, wherein the cap is connected to the socket by pressing the socket onto the cap until the flange bends around the annular insert to anchor the cap to the socket; and a male portion having a stud, wherein the male portion is connected to the female portion by snapping the stud into the socket such that the stud extends through the socket and into the cap, and wherein the teeth are configured to grip the stud when the stud is inserted into the female portion.

11. The snap button according to claim 10, wherein the flange is formed of a separate piece from the base body of the cap and is anchored to the cap.

12. The snap button according to claim 10, wherein the teeth are made of plastic and the base body and flange are made of metal.

13. The snap button according to claim 10, wherein the insert in the socket has an S-shaped cross-section.

14. The snap button according to claim 10, further comprising a plurality of spikes arranged on the bottom surface of the base body circumferentially around an outside of the flange, said spikes being configured for gripping a layer of fabric disposed between the cap and socket when the cap and socket are connected.

15. The snap button according to claim 10, wherein there are between two and five teeth.

16. A snap button comprising:

a female portion comprising:

a cap formed from a base body having a top surface, a bottom surface, a circumferential flange extending from said bottom surface, said flange having a plurality of interruptions therein, and a plurality of spikes arranged on the bottom surface of the base body circumferentially around an outside of the flange;

a socket formed by a disc having a top surface, a bottom surface, a central aperture and an annular insert disposed within the socket, wherein the cap is connected to the socket by pressing the socket onto the cap until the flange bends around the annular insert to anchor the cap to the socket; and a male portion having a stud, wherein the male portion is connected to the female portion by snapping the stud into the socket such that the stud extends through the socket and into the cap, wherein the spikes are configured for gripping a layer of fabric disposed between the cap and socket when the cap and socket are connected.

17. The snap button according to claim 16, wherein the flange is formed of a separate piece from the base body of the cap and is anchored to the cap.

18. The snap button according to claim 16, further comprising a set of teeth arranged circumferentially around an inside of the flange, said teeth being configured to grip the stud when the stud is inserted into the female portion.

19. The snap button according to claim 18, wherein the teeth are made of plastic and the base body and flange are made of metal.

20. The snap button according to claim 16, wherein the insert in the socket has an S-shaped cross-section.

21. The snap button according to claim 18, wherein there are between two and five teeth.

22. The snap button according to claim 16, further comprising a ring spring disposed in the socket to grip the stud when the stud is inserted into the central aperture in the socket.

* * * * *